US005178280A

United States Patent [19]

Ohlsson

[11] Patent Number: 5,178,280

[45] Date of Patent: Jan. 12, 1993

[54] DISTRIBUTION UNIT OF PACKAGES

[75] Inventor: Ingemar Ohlsson, Malmö , Sweden

[73] Assignee: AB Profer, Lund, Sweden

[21] Appl. No.: 585,024

[22] Filed: Sep. 18, 1990

Related U.S. Application Data

[63] Continuation of Ser. No. 400,102, Aug. 29, 1989, abandoned.

[30] Foreign Application Priority Data

Oct. 5, 1988 [SE] Sweden ..... 8803525

[51] Int. Cl.[5] ..... B65D 21/02; B65D 85/62

[52] U.S. Cl. ..... 206/499; 206/431; 220/23.83

[58] Field of Search ..... 229/4.5; 220/23.9, 23.6, 220/23.83; 206/427, 431, 432, 499, 500

[56] References Cited

U.S. PATENT DOCUMENTS

| | | | |
|---|---|---|---|
| 1,190,723 | 7/1916 | Casylor | 220/1 BC |
| 1,961,535 | 6/1934 | Taylor | 229/4.5 |
| 2,045,730 | 6/1936 | Schepman et al. | 206/499 X |
| 2,154,584 | 4/1939 | Rossi | 229/4.5 X |
| 2,182,872 | 12/1939 | Karl | 220/DIG. 13 |
| 2,207,003 | 7/1940 | Dunlap | 229/4.5 |
| 2,249,487 | 7/1941 | Musolf | 229/4.5 X |
| 2,267,246 | 12/1941 | Meade | 229/4.5 |
| 2,633,269 | 3/1953 | Hirschhorn | 206/499 X |
| 3,288,311 | 11/1966 | Beattie . | |
| 3,302,834 | 2/1967 | Alsop . | |
| 3,459,326 | 8/1969 | Betjemann . | |
| 3,693,788 | 9/1972 | Oglesbee | 206/432 |
| 3,788,963 | 1/1974 | Ruff | 206/432 |
| 3,919,176 | 12/1976 | Lipfert et al. | 220/23.4 |
| 4,023,700 | 5/1977 | Buquet et al. . | |
| 4,049,122 | 9/1977 | Maxwell . | |
| 4,067,433 | 1/1978 | Phipps . | |
| 4,190,188 | 2/1980 | Ohmori | 229/4.5 X |
| 4,261,502 | 4/1981 | Ohmori | 229/4.5 X |

FOREIGN PATENT DOCUMENTS

| | | |
|---|---|---|
| 2727461 | 1/1979 | Fed. Rep. of Germany . |
| 861180 | 9/1981 | U.S.S.R. . |
| 1154247 | 6/1969 | United Kingdom . |
| WO84/01938 | 5/1984 | World Int. Prop. O. . |

*Primary Examiner*—Bryon P. Gehman

*Attorney, Agent, or Firm*—Burns, Doane, Swecker & Mathis

[57] ABSTRACT

A liquid package of pressurized contents is manufactured from a thin metal foil laminated with plastic material. The package is shaped as a truncated cone and is preferably dimentioned such that the ratio of the radius R of the bottom of the cone to the radius r of the top of the cone is $r \approx 0.40R$.

5 Claims, 2 Drawing Sheets

DISTRIBUTION UNIT OF PACKAGES

This application is a continuation of application Ser. No. 07/400,102 filed Aug. 29, 1989.

FIELD OF THE INVENTION

The present invention relates to a package and more particularly, a liquid package for pressurized contents.

BACKGROUND OF THE INVENTION

A demand has existed for a long time for inexpensive and ecologically beneficial packages for pressurized, carbonated beverages. The packages found on the market today are glass bottles, aluminium cans and plastic bottles. Each of these has some advantages and disadvantages.

Glass has good properties that permits the manufacture of a gas-tight package which withstands the inner pressure the contents exercise on the package and which does not affect the taste of the liquid contents. Glass bottles can be cleaned and refilled or crushed when the raw material is to be used anew for bottle manufacture. The ability wash and refill glass bottles may be considered advantageous but the washing process entails undesirable expense and an appreciable consumption of energy. Conventional glass bottles, moreover, are heavy and occupy a large space in transport. The weight makes them also less attractive for the consumer.

The aluminium cans are also eminently suitable for recycling. The main disadvantage of aluminium as packing material, however, is the expensive and energy-demanding manufacture of aluminium, which also tends to become more expensive still with rising energy prices. A further disadvantage of this type of packages is that the inside surface of the cans is varnished and this varnish contains solvents which negatively affect the taste of the liquid. Furthermore, empty packages which are transported to the brewery cannot be stacked into one another, so that the transport becomes inefficient and expensive.

Plastic bottles which are also encountered on the market for carbonated beverages are expensive. The plastic raw material may be reused, however, for another manufacture, such as e.g. insulating padding in clothing.

The development of a wholly new packaging for pressurized contents requires all of the abovementioned aspects to be carefully weighed. The packaging should be inexpensive and the manufacture should not be too energy-demanding or require an expensive raw material. The package should be recoverable. Moreover, it should be light from a point of view of the consumer and of transport and, in particular, it should be stackable for a more efficient transport in the empty state. The packing material should protect the product and it should not affect its taste and quality. The material also should be gastight and withstand the internal pressure which the liquid exercises on the package.

OBJECTS AND SUMMARY OF THE INVENTION

It is an object of the present invention to make possible the manufacture of a cheaper and ecologically more beneficial package for pressurized contents which possesses the properties enumerated above.

It is a further object of the present invention to provide a package where the contents are in contact with a thermoplastic material which in contrast to vanish, does not affect the quality of the liquid contents and in which the liquid is protected from light, which also contributes to the retention of the quality and taste of the liquid contents.

It is a further object of the present invention to provide the package with a characteristic and attractive appearance in a form which contributes to a good utilization of volume during distribution.

These and other objects have been achieved in accordance with the present invention in that a liquid package is in the shape of a truncated cone where the relationship between top radius and bottom radius can be expressed by the formula $r \approx 0.4\ R$, where r designates the radius of the top surface and R designates the radius of the bottom surface.

BRIEF DESCRIPTION OF THE DRAWINGS

The invention will now be described in more detail with reference to the attached drawings wherein.

DETAILED DESCRIPTION OF A PREFERRED EMBODIMENT

Figure 1:
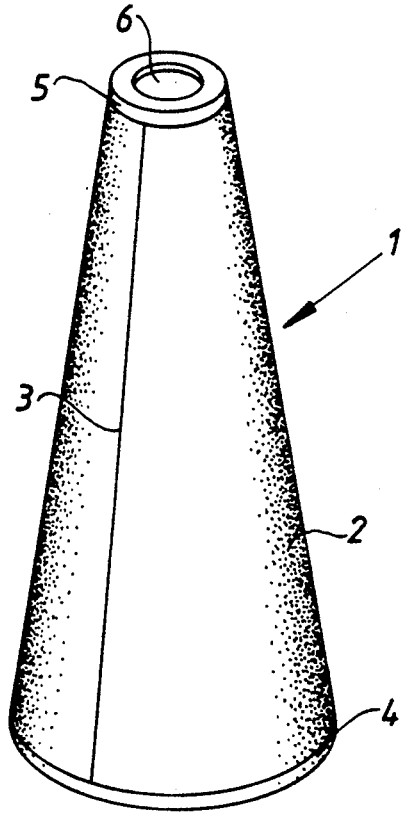
FIG. 1 is a perspective view of the package according to the present invention.

As is evident from FIG. 1 the package 1 in accordance with the present invention is in the shape of a truncated cone, with a shell surface 2 manufactured from a thin metal foil, e.g. thin sheet steel, laminated at least on one side with a thermoplastic material. The metal foil has good gas-tightness properties. The thermoplastic material is chosen so that it has good welding characteristics. Moreover, it should have good adhesion capacity to metal and it should be ecologically beneficial. If a choice is made to manufacture the shell surface 2 of thin sheet steel, it is also possible to make use of recycled scrap during manufacture and thus make the manufacture less expensive. The sheet steel too may possibly be recovered.

The stamped out sheet is rolled into a cone and the thermoplastic material on its surface is welded with an overlap to form a longitudinal joint 3. The joint 3 coincides with a generatrix on the truncated cone.

The package 1 is provided with a bottom 4 and a top 5. The bottom 4, which may be manufactured of thermoplastics or sheet metal, may include be wholly closed or it may comprise an opening device. The bottom 4 should be designed so that it can withstand the pressure from the enclosed liquid. If it is chosen to make the bottom 4 of sheet metal it should be covered at least on one side by laminating or otherwise applying a thermoplastic material thereto and the sheet metal may be welded together with the thermoplastic layer of the shell surface 2 by heating.

An opening device 6 may be fitted to the top 5 or bottom 4 in a tight manner which on opening of the package 1 is intended to be torn off so that the enclosed liquid becomes accessible for consumption.

Figure 2:
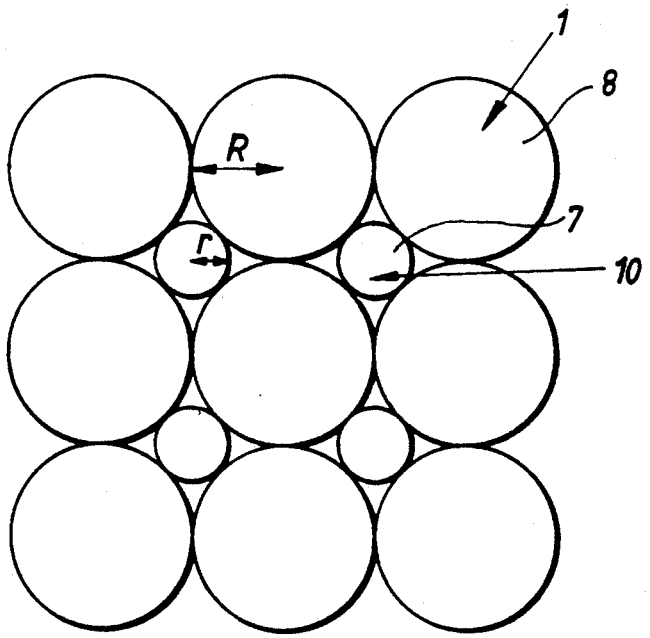
FIG. 2 is top view of a plurality of packages showing the relationship between the top radius and the bottom radius

The truncated cone is configured in a manner such that the relationship between the radii of its top and bottom surfaces can be expressed by the formula $r=(\sqrt{2}-1)$ R, which corresponds to $\approx 0.4$ R, where R designates the radius of the top surface 7 and R the radius of the bottom surface 8, which is illustrated in FIG. 2.

The bottom radius is chosen so that it fits the module used in the handling of distribution and transport. The top radius then can be calculated according to the aforementioned formula $r=(\sqrt{2}-1)R$. The height of the package, and with it also the cone angle, is determined by the volume, bearing in mind the product volume, head space, that is to say splash space, and bottom and top design. The height, and the cone angle connected therewith, are limited by practical considerations in respect of the ease of handling and the desire that the packages should make the best possible use of the distribution units.

The enclosed volume is calculated by the formula $$\frac{\pi H}{3} R^2(3-\sqrt{2})$$

where H represents the height and R the radius of the bottom area 8.

Figure 3:
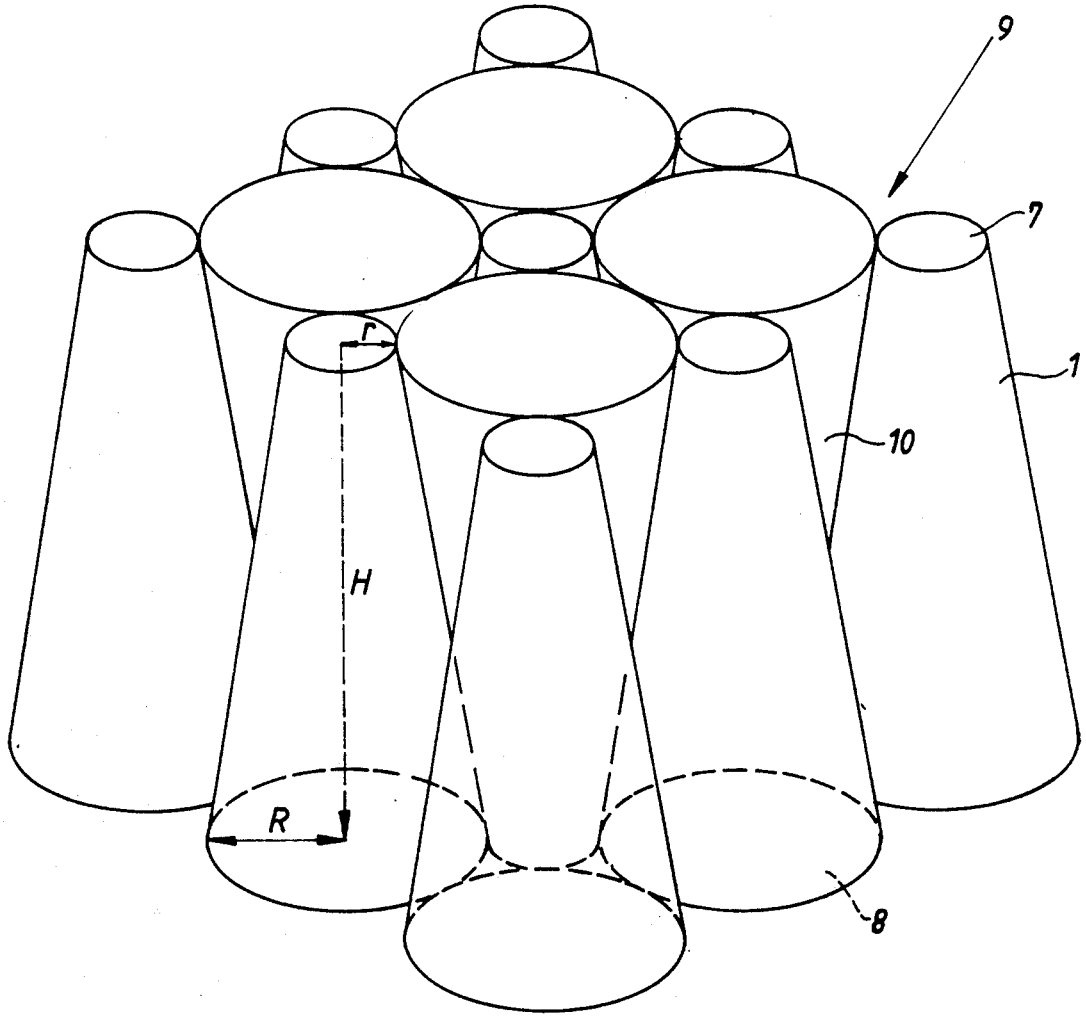
FIG. 3 is a perspective view showing one embodiment of a packing pattern as a distribution unit.

FIG. 3 shows a distribution unit 9 that includes a plurality of packages 1,10. With different package dimensions, of course, a great number of other packing patterns may exist taking into consideration the transport and distribution modules.

FIG. 3 demonstrates also that if a package 10 with the aforementioned relationship between the radii of top and bottom surfaces is positioned upside down, that is to say reversed between four adjoining packages 1 positioned the right way up, the reversed package 10 will rest on its top surface 7. In other words, the top surface 7 will be wholly on a level with the bottom surfaces 8 of the four packages 1 which are positioned the right way up. At the same time a tangential touch is obtained along four whole generatrices on the shell surface 2 of the reversed package 10 and one whole generatrix on each shell surface 2 of the four packages 1 which are positioned the right way up. Thus a good utilization is obtained of the space which the packages 1 occupy in their distribution unit 9. The packing pattern is held together e.g. by being shrink-wrapped or enclosed, in some form, by the distribution unit. To hold the units 9 together the space can be utilized better, moreover, by turning every other unit 9 upside down. The units 9 can also be stacked in vertical direction, since their surfaces are wholly plane and the internal pressure of the packages 1 imparts to them great strength and endurance against the effect of external pressure.

As is evident from the above description, a liquid package is provided by the present invention which complies with the demands regarding gas tightness and strength for carbonated beverages and which is cheaper than the liquid packages for pressurized contents on the market at present. The liquid packages in accordance with the present invention, moreover, are ecologically more beneficial, since they can be manufactured mainly from recycled material which can be recovered again. The manufacture, moreover, is not as energy-demanding as e.g. that of aluminium cans. By means of the present invention, moreover, a package is obtained which in an improved manner preserves the quality and taste of the enclosed beverage, as the enclosed beverage is in contact with a thermoplastic material and as it is protected against light by the metal foil.

While this invention has been illustrated and described in accordance with a preferred embodiment, it is recognized that variations and changes may be made and equivalents employed herein without departing from the invention as set forth in the claims.

I claim:

1. A distribution unit of packages, comprising:

a plurality of truncated cone-shaped packages, each of said packages having a planar top surface at one end thereof and a planar bottom surface at the opposite end thereof, said plurality of packages including four first packages having their top surfaces lying in substantially a same first plane and having their bottom surfaces lying in substantially a same second plane, and a second package having its top surface lying substantially in said second plane and its bottom surface lying substantially in said first plane, each of said four first packages contacting two of said four first packages, said second package contacting each of said four first packages along a line extending from top surface of a respective first package and the bottom surface of the second package to the bottom surface of the respective first package and the top surface of the second package.

2. The distribution unit of packages according to claim 1, wherein each first and second of said packages is fabricated from a metal foil laminated on at least one side with a thermoplastic material.

3. A distribution unit of packages, comprising:

a plurality of truncated cone-shaped packages, each of said packages having a planar substantially circular top surface at one end thereof and a planar substantially circular bottom surface at the opposite and thereof, said plurality of packages including four first packages having their top surfaces lying substantially in a first plane and having their bottom surfaces lying substantially in a second plane, and a second package having its top surface lying substantially in said second plane and its bottom surface lying substantially in said first plane, the top surface of said first and second packages having the same radius and the bottom surface of said first and second packages having the same radius, each of said four first packages contacting two of said four first packages, said second package contacting each of said four first packages along a line extending from the top surface of a respective first package and the bottom surface of the second package to the bottom surface of the respective first package and the top surface of the second package, and the ratio of the radius of the top surface of the first and second packages to the radius of the bottom surface of the first second packages being about 0.4.

4. The distribution unit of packages according to claim 3, wherein each of said first and second packages is fabricated from a metal foil laminated on at least one side with a thermoplastic material.

5. The distribution unit of packages according to claim 3, wherein said second package is positioned in the center of said four first packages, and said four first packages are substantially equally spaced around the circumference of said second package.

* * * * *